US011000061B2

(12) United States Patent
Lavanant et al.

(10) Patent No.: US 11,000,061 B2
(45) Date of Patent: May 11, 2021

(54) AEROSOL-GENERATING ARTICLE COMPRISING A LIQUID DELIVERY ELEMENT

(71) Applicant: PHILIP MORRIS PRODUCTS S.A., Neuchatel (CH)

(72) Inventors: Laurent Lavanant, Evian-les-Bains (FR); Yves Jordil, Lausanne (CH)

(73) Assignee: Philip Morris Products S.A., Neuchatel (CH)

( * ) Notice: Subject to any disclaimer, the term of this patent is extended or adjusted under 35 U.S.C. 154(b) by 584 days.

(21) Appl. No.: 15/737,836

(22) PCT Filed: Jul. 11, 2016

(86) PCT No.: PCT/EP2016/066452

§ 371 (c)(1),
(2) Date: Dec. 19, 2017

(87) PCT Pub. No.: WO2017/009298

PCT Pub. Date: Jan. 19, 2017

(65) Prior Publication Data

US 2019/0000134 A1 Jan. 3, 2019

(30) Foreign Application Priority Data

Jul. 10, 2015 (EP) ..... 15176357

(51) Int. Cl.
*A24D 3/04* (2006.01)
*A24D 3/06* (2006.01)

(52) U.S. Cl.
CPC ..... *A24D 3/048* (2013.01); *A24D 3/04* (2013.01); *A24D 3/061* (2013.01)

(58) Field of Classification Search
None
See application file for complete search history.

(56) References Cited

U.S. PATENT DOCUMENTS 7,578,298 B2 8/2009 Karles
9,516,895 B2 12/2016 Awty
(Continued)

FOREIGN PATENT DOCUMENTS

CN 1086108 5/1994
CN 0591048 6/1999
(Continued)

OTHER PUBLICATIONS

European Extended Search Report for Application No. 15176357.0 dated Jan. 18, 2016 (11 pages).
(Continued)

*Primary Examiner* — Michael H. Wilson
*Assistant Examiner* — Katherine A Will
(74) *Attorney, Agent, or Firm* — Mueting Raasch Group

(57) ABSTRACT

There is provided an aerosol-generating article (10) comprising an aerosol-generating substrate (12) and a mouthpiece (14) secured to a downstream end of the aerosol-generating substrate (12). The mouthpiece (14) comprises at least one segment of filter material (18) and a liquid delivery element (22). The liquid delivery element (22) comprises an upstream end and a downstream end, a cavity (28) containing a liquid, and at least one channel (26) extending between the upstream end and the downstream end of the liquid delivery element (22). The liquid delivery element (22) is arranged to deliver the liquid to the at least one segment of filter material (18) when activated by a consumer.

13 Claims, 3 Drawing Sheets

(56) References Cited

U.S. PATENT DOCUMENTS

| | | | | |
|---|---|---|---|---|
| 10,609,955 | B2 | 4/2020 | Beard | |
| 10,729,171 | B2 | 8/2020 | Penrose | |
| 2013/0032161 | A1 | 2/2013 | Herholdt | |
| 2014/0182607 | A1* | 7/2014 | Awty | A24D 3/048 131/280 |

FOREIGN PATENT DOCUMENTS

| | | |
|---|---|---|
| CN | 102100401 | 6/2011 |
| CN | 103763949 | 4/2014 |
| CN | 104244746 | 12/2014 |
| EP | 0276021 | 7/1988 |
| EP | 2923588 | 9/2015 |
| GB | 2490730 | 11/2012 |
| JP | 64-080273 | 3/1989 |
| JP | 2014/513540 | 5/2011 |
| JP | 2013-518569 | 5/2013 |
| JP | 2014-518079 | 7/2014 |
| WO | WO 03/037115 | 5/2003 |
| WO | WO 2006/082529 | 8/2006 |
| WO | WO 2012/156705 | 11/2012 |
| WO | WO 2013/000967 | 1/2013 |
| WO | WO 2013/160006 | 10/2013 |
| WO | WO 2014/102094 | 7/2014 |
| WO | WO 2014/156839 | 10/2014 |
| WO | WO 2015/101605 | 7/2015 |

OTHER PUBLICATIONS

International Search Report and Written Opinion issued for PCT/EP2016/066452 dated Aug. 14, 2016 (13 pages).

Office Action issued in China for Application No. 201680038507.3 dated Feb. 3, 2020 (19 pages). English translation included.

Office Action issued in Japan for Application No. 2017-567154 dated Jul. 13, 2020 (8 pages). English translation included.

* cited by examiner

AEROSOL-GENERATING ARTICLE COMPRISING A LIQUID DELIVERY ELEMENT

This application is a U.S. National Stage Application of International Application No. PCT/EP2016066452 filed Jul. 11, 2016, which was published in English on Jan. 19, 2017, as International Publication No. WO 2017/009298 A1. International Application No. PCT/EP2016/066452 claims priority to European Application No. 15176357.0 filed Jul. 10, 2016.

The present invention relates to an aerosol-generating article comprising a liquid delivery element. The invention finds particular application as an elongate smoking article, such as a cigarette.

Smoking articles, such as cigarettes, typically comprise an aerosol-generating article, such as a tobacco rod, attached to a mouthpiece. Conventional mouthpieces comprise one or more segments of a filtration material such as cellulose acetate tow. In some cases, it may be desirable to provide a liquid within the filtration material to alter a taste sensation experienced by a consumer during smoking of the smoking article. For example, it may be desirable to provide water or a liquid flavourant within the filtration material. However, liquids deposited directly onto the filtration material during manufacture of the smoking article may escape during storage and cause staining of other components of the smoking article, or the packaging. Volatile liquids deposited directly onto the filtration material during manufacture may escape the smoking article and the package entirely.

Some attempts to reduce or eliminate the leakage or escape of liquids from the mouthpieces of smoking articles use a container positioned within the mouthpiece and in which the liquid is contained until a consumer releases the liquid from the container, either immediately before or during smoking of the smoking article. For example, EP-0276021-A2 describes a cigarette comprising a breakable plastic capsule situated in the vicinity of a filter member, the breakable plastic capsule containing a fluid material. However, the breakable plastic capsule described in EP-0276021-A2 is combined with additional components, such as a corrugated sheet wrapped around the breakable plastic capsule, to form smoke passages around the breakable plastic capsule. The cigarettes described in EP-0276021-A2 are therefore complex to manufacture, requiring the registration and assembly of multiple components to form the filter section of each cigarette.

WO 2014/156839 A1 describes filter having a breakable capsule incorporated within a cavity. The peripheral wall of the capsule includes thin-walled regions in the form of grooves, wherein the thin-walled regions are easier to break than the other regions when a force is applied to the capsule by the consumer.

Accordingly, it would be desirable to provide an aerosol-generating article that overcomes such disadvantages associated with known smoking articles. In particular, it would be desirable to provide an aerosol-generating article that includes means for delivering a liquid to a segment of filter material, maintains a desirable resistance to draw through the article, and can be manufactured with minimal modification to existing high speed manufacturing machines and processes.

According to a first aspect of the present invention there is provided an aerosol-generating article having a length extending in a longitudinal direction between upstream and downstream ends of the aerosol-generating article, the aerosol-generating article having a substantially circular cross-sectional shape defining a circumferential direction extending around the longitudinal direction and a radial direction orthogonal to the longitudinal direction and the circumferential direction. The aerosol-generating article comprises an aerosol-generating substrate and a mouthpiece secured to a downstream end of the aerosol-generating substrate, the mouthpiece comprising at least one segment of filter material and a liquid delivery element. The liquid delivery element comprises an upstream end, a downstream end, a cavity containing a liquid, and a liquid delivery portion configured to deliver the liquid to the at least one segment of filter material when the liquid delivery element is activated. The liquid delivery element further comprises at least one channel defining surface, defining a channel extending between the upstream end and the downstream end of the liquid delivery element, wherein the at least one channel has a maximum depth extending in the radial direction and a maximum width extending in the circumferential direction, and wherein the ratio of the maximum depth to the maximum width is between about 0.5 to 1 and about 2 to 1, and wherein the at least one channel defining surface of the liquid delivery element is distinct from the liquid delivery portion of the liquid delivery element.

As used herein, the terms 'upstream' and 'downstream' are used to describe the relative positions of elements, or portions of elements, of the aerosol-generating article in relation to the direction in which a consumer draws on the aerosol-generating article during use thereof. Aerosol-generating articles as described herein comprise a downstream end (that is, the mouth end) and an opposed upstream end. In use, a consumer draws on the downstream end of the aerosol-generating article. The downstream end is downstream of the upstream end, which may also be described as the distal end.

As used herein, the term 'aerosol-generating substrate' is used to describe a substrate capable of releasing, upon heating, volatile compounds, which can form an aerosol. The aerosol generated from aerosol-generating substrates may be visible or invisible and may include vapours (for example, fine particles of substances, which are in a gaseous state, that are ordinarily liquid or solid at room temperature) as well as gases and liquid droplets of condensed vapours.

By providing a liquid within a cavity of a liquid delivery element, aerosol-generating articles according to the present invention can reduce or prevent escape of the liquid from the aerosol-generating article during storage.

Furthermore, providing the liquid within a cavity of a liquid delivery element also provides the consumer with a choice over when to deliver the liquid from the liquid delivery element to the at least one segment of filter material. For example, a consumer may choose to deliver the liquid to the at least one segment of filter material immediately before smoking the aerosol-generating article, or during smoking of the aerosol-generating article. Alternatively, a consumer may choose to smoke the aerosol-generating article without delivering the liquid from the liquid delivery element to the at least one segment of filter material.

By providing a liquid delivery element comprising at least one channel defining surface to define a channel extending between the upstream and downstream ends of the liquid delivery element, aerosol-generating articles according to the present invention can incorporate the liquid delivery element into the mouthpiece and maintain a resistance to draw that is similar to, or lower than, the resistance to draw of a corresponding aerosol-generating article that does not include a liquid delivery element, such as a conventional filter cigarette. The channel may therefore in effect be formed as an integral part of the liquid delivery element.

Furthermore, by forming the at least one channel as part of the liquid delivery element that extends between the upstream and downstream ends, aerosol-generating articles according to the present invention can be manufactured using existing high speed manufacturing machines and processes with minimal modification. In particular, the liquid delivery element can be combined with other mouthpiece segments, such as the at least one segment of filter material, using a conventional combining process.

By arranging for the at least one channel defining surface of the liquid delivery element to be distinct from the liquid delivery portion of the liquid delivery element, the channels of the aerosol-generating article can remain substantially unaffected when the liquid delivery element is activated to deliver the liquid to the at least one segment of filter material. That is, the size and profile of the channels can remain substantially the same before and after the liquid delivery element is activated. This can advantageously help to maintain a consistent resistance to draw during use of the aerosol-generating article. The term "distinct" is used herein to indicate that the at least one channel defining surface does not form the same part of the liquid delivery element as the liquid delivery portion. That is the at least one channel defining surface is not configured to deliver the liquid to the at least one segment of filter material when the liquid delivery element is activated.

Forming the at least one channel so that the ratio of the maximum depth of the at least one channel to the maximum width of the at least one channel is between about 0.5 to 1 and about 2 to 1 can advantageously maintain the structural integrity of the at least one channel in embodiments in which the liquid delivery element may be activated by squeezing the liquid delivery element. Preferably, the ratio of the maximum depth of the at least one channel to the maximum width of the at least one channel is between about 0.7 to 1 and about 2 to 1, more preferably between about 0.8 to 1 and about 2 to 1. In some embodiments, the at least one channel may have a substantially circular cross-sectional shape so that the ratio of the maximum depth of the at least one channel to the maximum width of the at least one channel is about 1 to 1. In other embodiments, the at least one channel may have a substantially elliptical cross-sectional shape so that the ratio of the maximum depth of the at least one channel to the maximum width of the at least one channel is a ratio other than 1 to 1.

For example, in some embodiments the liquid delivery element may comprise at least one groove in a surface of the liquid delivery element. That is, the at least one channel defining surface forms a groove in the surface of the liquid delivery element. The groove extends between the upstream and downstream ends of the liquid delivery element. In such embodiments, the aerosol-generating article further comprises a wrapper wrapped around the liquid delivery element, wherein the wrapper overlies the at least one groove to form or at least partially define the at least one channel extending within the at least one groove. In this way, the channel is formed from the space enclosed between the surface of the groove and the inner surface of the wrapper that overlies the groove. In such embodiments, forming the at least one channel with a ratio of maximum depth to maximum width of between about 0.5 to 1 and about 2 to 1 may reduce or prevent permanent deformation of the wrapper into the at least one groove if the liquid delivery element is squeezed to activate the liquid delivery element.

Preferably, the at least one wrapper is a plug wrap. The plug wrap may circumscribe only the liquid delivery element. Alternatively, the plug wrap may be a combining plug wrap circumscribing the liquid delivery element and the at least one segment of filter material.

The plug wrap is preferably adhered to surface of the liquid delivery element so that the plug wrap is substantially sealed to the surface of the liquid delivery element, except along the at least one groove. That is, the plug wrap is preferably adhered to the liquid delivery element so that air may flow between the plug wrap and the liquid delivery element only along the at least one channel formed by the at least one groove in combination with the plug wrap. Adhering the plug wrap to the liquid delivery element may also prevent movement of the liquid delivery element with respect to other components of the mouthpiece during manufacture of the aerosol-generating article. Preferably the adhesive is a low temperature adhesive so that the adhesive can be applied to the plug wrap and the liquid delivery element at a temperature that is sufficiently low to prevent damage to the liquid delivery element and to prevent spoiling of the liquid within the cavity. A suitable adhesive is polyvinyl acetate.

As an alternative to using at least one groove in a surface of the liquid delivery element to form the at least one channel, the liquid delivery element may comprise a wall defining the cavity, and the at least one channel defining surface is disposed within the wall and defines at least one channel extending through the wall between the upstream and downstream ends of the liquid delivery element. That is, the at least one channel is contained within the liquid delivery element, and in particular, within the wall of the liquid delivery element, so that the at least one channel is defined only by the wall forming at least part of the liquid delivery element and also defining the cavity. In such embodiments, forming the at least one channel with a ratio of maximum depth to maximum width of between about 0.5 to 1 and about 2 to 1 may reduce or prevent permanent deformation of the at least one channel if the liquid delivery squeezed to activate the liquid delivery element.

Forming a liquid delivery element comprising a wall defining a cavity containing a liquid and wherein at least one channel extends through the wall between an upstream end and a downstream end of the liquid delivery element is both novel and inventive in its own right. Therefore, according to a second aspect of the present invention there is provided an aerosol-generating article comprising an aerosol-generating substrate and a mouthpiece secured to a downstream end of the aerosol-generating substrate, the mouthpiece comprising at least one segment of filter material and a liquid delivery element. The liquid delivery element comprises an upstream end and a downstream end, a cavity containing a liquid, and at least one channel extending through the liquid delivery element between the upstream end and the downstream end. The liquid delivery element is configured to deliver the liquid to the at least one segment of filter material when activated by a consumer.

Forming the at least one channel as an integral part of the liquid delivery element so that the at least one channel extends through the liquid delivery element can minimise the risk of the at least one channel becoming contaminated or blocked during manufacture of the mouthpiece and the aerosol-generating article.

The following preferred and optional features of aerosol-generating articles according to the present invention can be applied to both the first and second aspects of the present invention in accordance with any of the embodiments described above.

As described above, the liquid within the cavity of the liquid delivery element can be delivered to the at least one segment of filter material when the liquid delivery element is activated by a consumer. Therefore, the term "activate" is used herein to refer to an action that causes the liquid delivery element to deliver the liquid from the cavity to the at least one segment of filter material.

The liquid delivery element may be configured for activation by piercing the cavity of the liquid delivery element.

Preferably, the liquid delivery element is configured for activation by squeezing the liquid delivery element. In such embodiments, when the liquid delivery element is squeezed, the compressive forces on the liquid delivery element preferably result in a reduction in the internal volume of the cavity, therefore increasing the internal pressure within the cavity and resulting in the release of the liquid from the liquid delivery element.

In those embodiments in which the liquid delivery element is configured for activation by squeezing the liquid delivery element, the liquid delivery portion of the liquid delivery element may comprise a valve transformable between a closed position and an open position, wherein activation of the liquid delivery element comprises transforming the valve into the open position to deliver the liquid from the cavity to the at least one segment of filter material.

Providing a valve to facilitate activation of the liquid delivery element can advantageously provide a consumer with greater control over the delivery of the liquid to the at least one segment of filter material. For example, the valve may be configured so that it can be transformed between the open and closed positions multiple times so that a consumer may choose to deliver only some of the liquid from the cavity to the at least one segment of filter material in a first instance and then deliver the remainder of the liquid from the cavity to the at least one segment of filter material at a later time.

Providing a valve to facilitate activation of the liquid delivery element may also simplify the manufacture of the liquid delivery element. For example, in some embodiments, the valve may comprise a deformable portion, and a slit within the deformable portion, and wherein the slit is transformable from the closed position to the open position when a force is applied to the liquid delivery element to deform the deformable portion. The deformable portion may be at least part of an end wall of the liquid delivery element.

In some embodiments, the slit may be transformable from the open position to the closed position when the compressive force is removed from the liquid delivery element so that the valve may be repeatedly opened and closed, as described above. In such embodiments, the deformable portion of the valve is preferably formed from an elastically deformable material. To simplify the manufacture of the liquid delivery element, preferably the entire liquid delivery element is formed from an elastically deformable material.

To provide a controlled and directed delivery of the liquid from the cavity into the at least one segment of filter material, the valve is preferably positioned adjacent the at least one segment of filter material. In some embodiments, it may be desirable to prevent leakage of the liquid from the aerosol-generating article once the liquid delivery element has been activated. Therefore, in such embodiments, the valve is preferably positioned at the upstream end of the liquid delivery element so that the liquid is delivered in the upstream direction upon activation of the liquid delivery element and therefore delivered away from the downstream mouth end of the aerosol-generating article.

Instead of a valve, in some embodiments the liquid delivery portion of the liquid delivery element may comprise a frangible portion, wherein the frangible portion is configured to release the liquid from the cavity when the frangible portion is broken as a result of squeezing the liquid delivery element. Forming the liquid delivery element with a frangible portion advantageously facilitates controlled delivery of the liquid to the at least one segment of filter material when the liquid delivery element is activated. For example, the frangible portion can be positioned adjacent to the at least one segment of filter material to ensure that the liquid is delivered directly to the at least one segment of filter material when the liquid delivery element is activated. Providing a frangible portion can also ensure that the compressive force required to activate the liquid delivery element is consistent across multiple aerosol-generating articles.

The frangible portion may be a weakened portion of a wall forming part of the cavity in liquid delivery element. For example, the liquid delivery element may be substantially cylindrical in shape and comprise upstream and downstream end walls that form end walls of the cavity. In such embodiments, at least one of the end walls may comprise a weakened portion, such as one or more grooves or scoring lines formed in the end wall. Alternatively, at least a portion of one of the end walls may have a reduced thickness compared to the other end wall, so that the area of reduced thickness forms the weakened portion.

To provide a controlled and directed delivery of the liquid from the cavity into the at least one segment of filter material, the frangible portion is preferably positioned adjacent the at least one segment of filter material. In some embodiments, it may be desirable to prevent leakage of the liquid from the aerosol-generating article once the liquid delivery element has been activated. Therefore, in such embodiments, the frangible portion is preferably positioned at the upstream end of the liquid delivery element so that the liquid is delivered in the upstream direction upon activation of the liquid delivery element and therefore delivered away from the downstream mouth end of the aerosol-generating article.

Alternatively, the liquid delivery portion of the liquid delivery element may comprise one or more apertures in fluid communication with the cavity, and a seal covering the one or more apertures. The seal may be connected to the remainder of the liquid delivery element by a frangible connection so that the seal at least partially detaches from the remainder of the liquid delivery element when a consumer squeezes the liquid delivery element to activate the liquid delivery element. For example, the seal may be connected to the remainder of the liquid delivery element by an adhesive having a sufficiently low bond strength so that the adhesive bond fails when the liquid delivery element is activated. Alternatively, the material forming the seal may be configured to rupture upon activation of the liquid delivery element. For example, the seal may comprise a thin membrane adhered to the remainder of the liquid delivery element and covering the at least one aperture, wherein the membrane will tear or otherwise rupture when a compressive force is applied to the liquid delivery element during activation. To ensure a reliable and consistent rupture of the membrane, one or more areas of weakening may be formed in the membrane. For example, one or more scoring lines may intersect at the centre of the membrane to define an area of weakening.

To provide a controlled and directed delivery of the liquid from the cavity into the at least one segment of filter material, the seal is preferably positioned adjacent the at least one segment of filter material. In some embodiments, it may be desirable to prevent leakage of the liquid from the aerosol-generating article once the liquid delivery element has been activated. Therefore, in such embodiments, the seal is preferably positioned at the upstream end of the liquid delivery element so that the liquid is delivered in the upstream direction upon activation of the liquid delivery element and therefore delivered away from the downstream mouth end of the aerosol-generating article.

As described above, the at least one channel extending between the upstream and downstream ends of the liquid delivery element can provide aerosol-generating articles according to both aspects of the present invention with a desired resistance to draw. A desired resistance to draw can be obtained by varying at least one of the number of channels extending through the liquid delivery element and the minimum cross-sectional area of each of the channels.

Preferably, the at least one channel comprises from one to five channels, more preferably from one to four channels, more preferably from one to three channels. The total number of channels may be one, two, three, four or five. In those embodiments in which the at least one channel is a plurality of channels, the plurality of channels are preferably spaced substantially equidistantly from each other to maintain a uniform airflow through the aerosol-generating article.

In any of the embodiments described above, each of the at least one channels may have any suitable cross-sectional shape. In some embodiments, each channel has a substantially square or rectangular cross-sectional shape. Preferably, each channel has a substantially circular cross-sectional shape. Channels having a substantially circular cross-sectional shape may provide optimum resistance to permanent deformation of the channels in those embodiments in which the liquid delivery element is activated by squeezing the liquid delivery element.

Preferably each channel has a minimum cross-sectional area measured at the narrowest point of each channel, wherein the total minimum cross-sectional area for the total number of channels is between about 1 square millimetre and about 6 square millimetres, preferably between about 1 square millimetre and about 2 square millimetres, more preferably between about 1 square millimetre and about 1.5 square millimetres.

Additionally, or alternatively, the liquid delivery element may have a length of between about 8 millimetres and about 12 millimetres, preferably about 10 millimetres. In those embodiments in which the liquid delivery element has a length of about 10 millimetres, forming the at least one channel so that the total minimum cross-sectional area for the total number of channels is between about 1 square millimetre and about 1.5 square millimetres may provide a resistance to draw that is substantially the same as, or similar to, an otherwise identical aerosol-generating article in which the liquid delivery element is replaced with a segment of filter material, such as cellulose acetate tow, having the same length of about 10 millimetres.

In those embodiments in which the liquid delivery element comprises a single channel, preferably the channel has a substantially circular cross-sectional shape with a diameter of between about 1.1 millimetres and about 1.4 millimetres. In those embodiments in which the liquid delivery element comprises two channels, preferably each channel has a substantially circular cross-sectional shape with a diameter of between about 0.55 millimetres and about 0.7 millimetres. In those embodiments in which the liquid delivery element comprises three channels, preferably each channel has a substantially circular cross-sectional shape with a diameter of between about 0.36 millimetres and about 0.47 millimetres. In those embodiments in which the liquid delivery element comprises four channels, preferably each channel has a substantially circular cross-sectional shape with a diameter of between about 0.27 millimetres and about 0.35 millimetres. In those embodiments in which the liquid delivery element comprises five channels, preferably each channel has a substantially circular cross-sectional shape with a diameter of between about 0.2 millimetres and about 0.28 millimetres.

In any of the embodiments described above, the at least one channel is preferably configured so that the aerosol-generating article has a resistance to draw of between about 5 millimetres of water gauge and about 80 millimetres of water gauge before the liquid is delivered from the liquid delivery element into the at least one segment of filter material. The resistance to draw of aerosol-generating articles according to the present invention may be substantially the same as, or similar to, the resistance to draw of otherwise identical aerosol-generating articles in which the liquid delivery element is replaced with a segment of filter material.

As used herein, the term 'resistance to draw' refers to the pressure required to force air through the full length of the object under test at the rate of 17.5 millilitres per second at 22 degrees Celsius and 101 kilopascals (760 Torr). Resistance to draw is expressed in units of millimetres water gauge (mmWG) and is measured in accordance with ISO 6565:2011.

The resistance to draw of the aerosol-generating article after the liquid is delivered from the liquid delivery element into the at least one segment of filter material may be similar to the resistance to draw of the aerosol-generating article before the liquid is delivered from the liquid delivery element into the at least one segment of filter material. Preferably, the aerosol-generating article is configured to have a resistance to draw of between about 10 millimetres of water gauge and about 30 millimetres of water gauge higher than the resistance to draw of the aerosol-generating article before the liquid is delivered from the liquid delivery element to the at least one segment of filter material. Additionally, or alternatively, the aerosol-generating article may be configured to have a resistance to draw of between about 15 millimetres of water gauge and about 110 millimetres of water gauge after the liquid is delivered from the liquid delivery element into the at least one segment of filter material.

In any of the embodiments described above, and particularly in those embodiments in which the liquid delivery element is activated by squeezing the liquid delivery element, the liquid delivery element may be formed from an elastically deformable material. Forming the liquid delivery element from an elastically deformable material advantageously facilitates the return of the liquid delivery element to its pre-activation shape after it has been activated and the compressive activation force has been released. Forming the liquid delivery element from an elastically deformable material so that the liquid delivery element retains its shape after activation can ensure that the at least one airflow channel is not permanently deformed and therefore does not impede airflow through the aerosol-generating article.

As an alternative to forming the liquid delivery element from an elastically deformable material, in some embodiments at least part of the liquid delivery element may be formed from a plastically deformable material. In such embodiments, at least one dimension of the liquid delivery element after the liquid delivery element has been squeezed and activated may be smaller than the same dimension of the liquid delivery element before the liquid delivery element has been activated. For example, in some embodiments a diameter of the liquid delivery element after the liquid delivery element has been squeezed and activated may be smaller than the same diameter of the liquid delivery element before the liquid delivery element has been activated. A reduction in diameter of the liquid delivery element may provide or increase airflow around the liquid delivery element, which may contribute a reduction in the resistance to draw of the aerosol-generating article. Such a reduction in the resistance to draw may counteract any increase in the resistance to draw of the aerosol-generating article resulting from the delivery of the liquid from the liquid delivery element to the at least one segment of filter material so that the overall resistance to draw of the aerosol-generating article after activation of the liquid delivery element is substantially the same as, or similar to, the resistance to draw of the aerosol-generating article before activation of the liquid delivery element.

In any of those embodiments in which the liquid delivery element is activated by squeezing or otherwise compressing the liquid delivery element, preferably the compressive force required to activate the liquid delivery element is between about 10 Newtons and about 80 Newtons, more preferably between about 15 Newtons and about 30 Newtons. Preferably, the at least one channel defining surface remains substantially unchanged after the liquid delivery element is subjected to such compressive forces. Consequently, preferably the size and shape of the one or more channels remains substantially unchanged after the liquid delivery element is subjected to such compressive forces. The compressive force may be determined using a universal tensile/compression testing machine equipped with 100 Newton tension load cell, such as Instron or equivalent, operating at about 30 millimetres per minute and at 22 degrees Celsius under 60 percent relative humidity. An example of a manual test machine is the Alluris Type FMI-220C2-Digital Force Gauge 0-200N, available from Alluris GmbH & Co.

In any of the embodiments described above, the aerosol-generating article may comprise a plug wrap circumscribing the liquid delivery element. The plug wrap may circumscribe only the liquid delivery element. Alternatively, the plug wrap may be a combining plug wrap circumscribing the liquid delivery element and the at least one segment of filter material. Preferably, at least one surface of the plug wrap is coated with an anti-staining coating to prevent leakage of the liquid through the plug wrap after it has been delivered from the cavity to the at least one segment of filter material. Suitable anti-staining coatings include ethyl cellulose and cellulose acetate.

In any of the embodiments described above, the material forming the liquid delivery element may have any suitable colour. In some embodiments, the liquid delivery element may be formed from a substantially transparent material. The term 'substantially transparent' is used to describe a material which allows at least a significant proportion of incident light to pass through it, so that it is possible to see through the material. In the present invention, a substantially transparent liquid delivery element may allow sufficient light to pass through it so that smoke or one or more other aerosols generated by the aerosol-generating substrate and passing through the at least one channel during smoking of the aerosol-generating article are visible through the substantially transparent liquid delivery element. Additionally, or alternatively, a substantially transparent liquid delivery element may allow sufficient light to pass through it so that the liquid within the cavity is visible before activation of the liquid delivery element.

The substantially transparent liquid delivery element may be completely transparent. Alternatively, the substantially transparent liquid delivery element may have a lower level of transparency while still transmitting sufficient light that at least one of the smoke or one or more other aerosols and the liquid are visible through the substantially transparent liquid delivery element.

In those embodiments in which the liquid delivery element is substantially transparent, preferably any materials overlying the liquid delivery element are formed from a substantially transparent material, or comprise one or more apertures so that a portion of the liquid delivery element is visible through the one or more apertures. Materials overlying the liquid delivery element may comprise one or more wrappers, such as one or more plug wraps and a tipping wrapper. In a particularly preferred embodiment, the liquid delivery element is formed from a substantially transparent material, the aerosol-generating article comprising a substantially transparent wrapper overlying at least a portion of the liquid delivery element, and a tipping wrapper comprising at least one aperture at least partially overlying the substantially transparent wrapper and the liquid delivery element.

In any of the embodiments described above, the liquid delivery element may be formed from a thermoplastic polymeric material. The use of one or more thermoplastic materials may facilitate formation of the liquid delivery element using a moulding process, which may simplify the formation of the liquid delivery element comprising the cavity and the at least one channel extending through the liquid delivery element. Suitable materials include at least one of polyethylene, polypropylene, polyethylene terephthalate, polylactic acid, polyvinyl(4-hydroxybutanal), and combinations thereof. A particularly suitable process for forming the liquid delivery element is blow-fill-sealing, which may combine into a single process the steps of forming the liquid delivery element, filling the cavity with the liquid and sealing the cavity.

In any of the embodiments described above, the liquid delivery element and the at least one segment of filter material may each have a substantially circular cross-sectional shape. Preferably, the maximum diameter of the liquid delivery element is substantially the same as the maximum diameter of the at least one segment of filter material. Forming the mouthpiece with a liquid delivery element and at least one segment of filter material having substantially the same diameters facilities manufacture of the mouthpiece and the aerosol-generating article using existing high speed combining machines and processes.

In any of the embodiments described above, the at least one segment of filter material may comprise a downstream filter segment positioned downstream of the liquid delivery element. When the downstream filter segment forms a mouth end of the aerosol-generating article, the downstream filter segment can advantageously provide a desirable mouth feel for the consumer that resembles the mouth feel of a conventional aerosol-generating article.

Additionally, or alternatively, the at least one segment of filter material may comprise an upstream filter segment positioned upstream of the liquid delivery element. In those embodiments in which the liquid delivery portion of the liquid delivery element comprises a frangible portion, the frangible portion is preferably positioned at the upstream end of the liquid delivery element and adjacent to the upstream filter segment so that when the liquid delivery element is activated the liquid is delivered to the upstream filter segment, away from a consumer's mouth.

Preferably, the at least one filter segment comprises at least one upstream filter segment and at least one downstream filter segment, wherein the liquid delivery element is positioned between the at least one upstream filter segment and the at least one downstream filter segment.

Preferably, the filtration material within each filter segment is a plug of fibrous filtration material, such as cellulose acetate tow, polylactide or paper. A filter plasticiser may be applied to the fibrous filtration material in a conventional manner, by spraying it onto the separated fibres, preferably before any particulate material is applied to the filtration material.

In any of the embodiments described above, the liquid within the cavity of the liquid delivery element may comprise water. The liquid may consist essentially of water.

Alternatively, the liquid may comprise one or more components in addition to water, or as an alternative to water. In those embodiments in which the liquid comprises one or more components in addition to water, each of the additional components may be dissolved in the water or suspended within the water.

In some embodiments the liquid may comprise at least one flavourant, preferably a hydrophilic flavourant. Suitable flavourants include at least one of acetoin, sucrose, sorbitol, ethyl lactate, citric acid, chicory extract, alpha ionone, lactic acid, pyruvic acid, vanilla oleoresin, butyl alcohol, butyric acid, benzyl alcohol, ethyl acetate, fenugreek extract, isobutyl alcohol, isobutyric acid, cyclotene, coffee dione, frambinone, 2-3 dimethyl pyrazine, ethyl butyrate, ethyl maltol, ethyl propionate, vanillin, furaneol, isobutyraldehyde, isovaleric acid, maltol, benzaldehyde, dimethyl sulphide, 2 methyl butyric acid, isovaleraldehyde, phenethyl alcohol, phenylacetic acid, heliotropine, valeric acid, valeraldehyde, and combinations thereof.

Additionally, or alternatively, the liquid may comprise at least one humectant. Suitable humectants include at least one of glycerol, malitol, xylitol, sorbitol, polyethylene glycol, triethylene glycol, butylene glycol, glycerin, polydextrose, and combinations thereof.

In any of the embodiments described above, the liquid may be substantially colourless. Alternatively, the liquid may be coloured. Coloured liquids may be preferable in those embodiments in which the liquid delivery element is formed from a substantially transparent material so that the coloured liquid is visible through the substantially transparent liquid delivery element and any overlying layers of material, as described above. Additionally, or alternatively, any layers of material overlying the at least one filter segment into which the liquid is delivered when the liquid delivery element is activated may be substantially transparent and, additionally or alternatively, any overlying layers of material may comprise one or more apertures through which the at least one filter segment is visible. In such embodiments, the coloured liquid is visible through the substantially transparent material and, additionally or alternatively, through the one or more apertures, after the liquid has been delivered to the at least one segment of filter material. Such overlying layers of material may include one or more plug wraps and a tipping wrapper. In a particularly preferred embodiment, the liquid is a coloured liquid, the liquid delivery element comprises a frangible portion at its upstream end configured to deliver the coloured liquid to an upstream filter segment when the liquid delivery element is activated, the aerosol-generating article comprising a substantially transparent wrapper overlying at least a portion of the upstream filter segment, and a tipping wrapper comprising at least one aperture at least partially overlying the substantially transparent wrapper and the upstream filter segment.

Aerosol-generating articles according to the present invention may be filter cigarettes or other aerosol-generating articles in which the aerosol-generating substrate comprises a tobacco material that is combusted to form smoke. Therefore, in any of the embodiments described above, the aerosol-generating substrate may comprise a tobacco rod.

Alternatively, aerosol-generating articles according to the present invention may be articles in which a tobacco material is heated to form an aerosol, rather than combusted. In one type of heated aerosol-generating article, a tobacco material is heated by one or more electrical heating elements to produce an aerosol. In another type of heated aerosol-generating article, an aerosol is produced by the transfer of heat from a combustible or chemical heat source to a physically separate tobacco material, which may be located within, around or downstream of the heat source. The present invention further encompasses aerosol-generating articles in which a nicotine-containing aerosol is generated from a tobacco material, tobacco extract, or other nicotine source, without combustion, and in some cases without heating, for example through a chemical reaction.

The invention will now be further described, by way of example only, with reference to the accompanying drawings in which.

Figure 1:
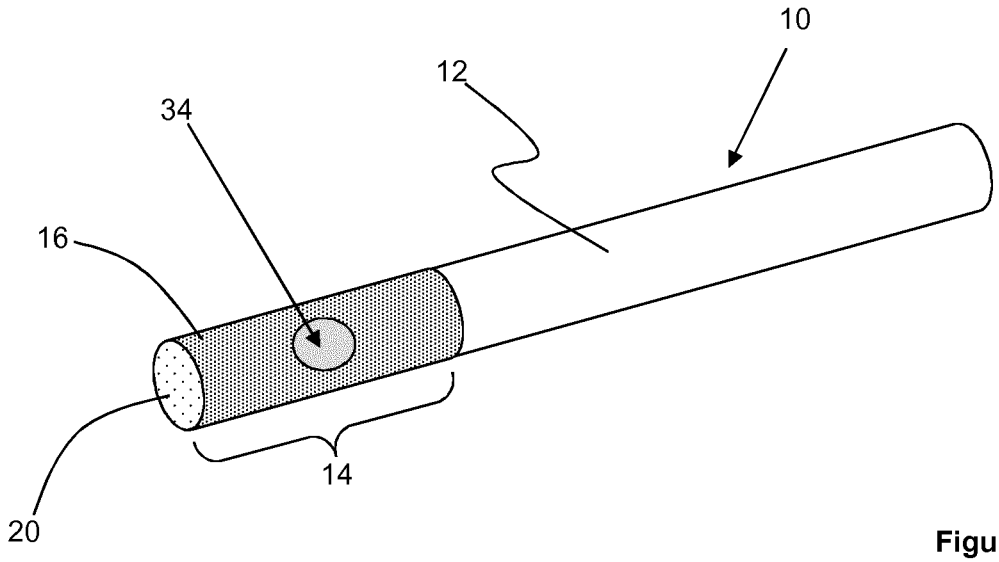
FIG. 1 shows a perspective view of an aerosol-generating article in accordance with the present invention.

FIG. 1 shows an aerosol-generating article 10 according to an embodiment of the present invention. The aerosol-generating article 10 is a filter cigarette comprising an aerosol-generating substrate 12 in the form of a wrapped tobacco rod, and a mouthpiece 14. The mouthpiece 14 is secured to the wrapped tobacco rod by a tipping wrapper 16.

Figure 2:
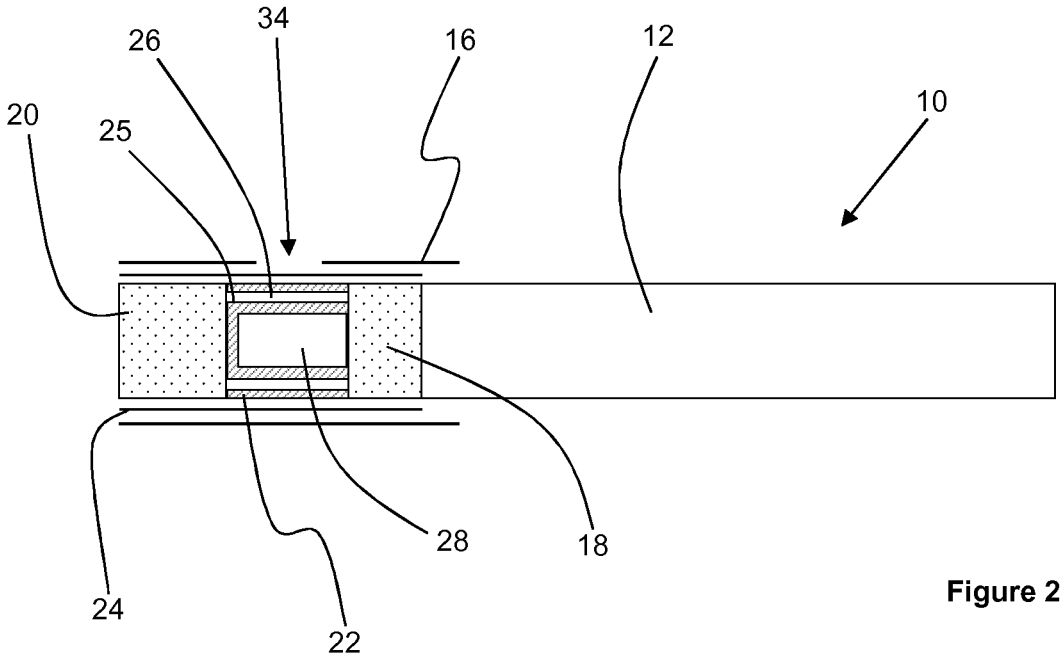
FIG. 2 shows a longitudinal cross-sectional view of the aerosol-generating article of FIG. 1 and comprising a liquid delivery element in accordance with a first embodiment of the present invention.

As shown more clearly in FIG. 2, which shows a longitudinal cross-sectional view of the aerosol-generating article 10 of FIG. 1, the mouthpiece 14 comprises an upstream filter segment 18 at an upstream end of the mouthpiece 14 and a downstream filter segment 20 at a downstream end of the mouthpiece 14. The mouthpiece 14 further comprises a substantially transparent liquid delivery element 22 positioned between the upstream and downstream filter segments 18, 20. A substantially transparent combining plug wrap 24 is wrapped around the upstream and downstream filter segments 18, 20 and the substantially transparent liquid delivery element 22 to combine them and form the mouthpiece 14.

Figure 3:
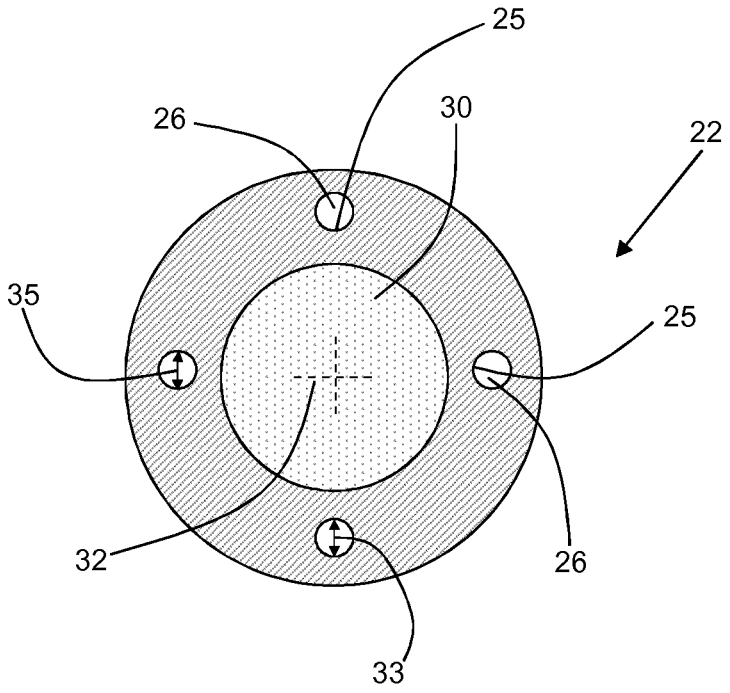
FIG. 3 shows the upstream end of the liquid delivery element of the aerosol-generating article of FIG. 2.

As shown in FIGS. 2 and 3, the liquid delivery element 22 comprises a plurality of channel defining surfaces 25, each surface defining a respective channel 26. Each channel 26 extends through the liquid delivery element 22 between its upstream and downstream ends. During smoking of the aerosol-generating article 10 mainstream smoke passes from the upstream filter segment 18 to the downstream filter segment 20 through the plurality of channels 26. Each channel 26 has a maximum depth 33 extending in a radial direction and a maximum width 35 extending in a circumferential direction. In the embodiment shown in FIG. 3 each channel 26 has a substantially circular cross-sectional shape so that the ratio of the maximum depth to the maximum width for each channel 26 is approximately 1 to 1.

The liquid delivery element 22 further comprises a cavity 28 positioned within the liquid delivery element, the cavity 28 containing a coloured liquid comprising water. The cavity 28 is open only at its upstream end, the upstream end of the cavity 28 being sealed by a frangible portion in the form of a thin membrane 30. Scoring lines 32 in the thin membrane 30 intersect at the centre of the thin membrane 30 to define an area of weakening in the thin membrane 30.

Before or during smoking of the aerosol-generating article 10 a consumer may squeeze the liquid delivery element 22 to increase the pressure within the cavity 28. The increased pressure will rupture the thin membrane 30 along the scoring lines 32, therefore activating the liquid delivery element and delivering the coloured liquid from the cavity 28 into the upstream filter segment 18. An aperture 34 in the tipping wrapper 16 overlies the substantially transparent liquid delivery element 22 and the substantially transparent combining plug wrap 24 so that, before activation of the liquid delivery element 22, the consumer can observe the coloured liquid within the cavity 28. During activation of the liquid delivery element 22 the consumer can observe, through the aperture 34 in the tipping wrapper 16, the liquid moving out of the cavity 28 and into the upstream filter segment 18. During smoking of the aerosol-generating article 10 the consumer can observe, through the aperture 34 in the tipping wrapper 16, mainstream smoke from the wrapped tobacco rod passing through the plurality of channels 26 in the substantially transparent liquid delivery element 22.

Figure 4:
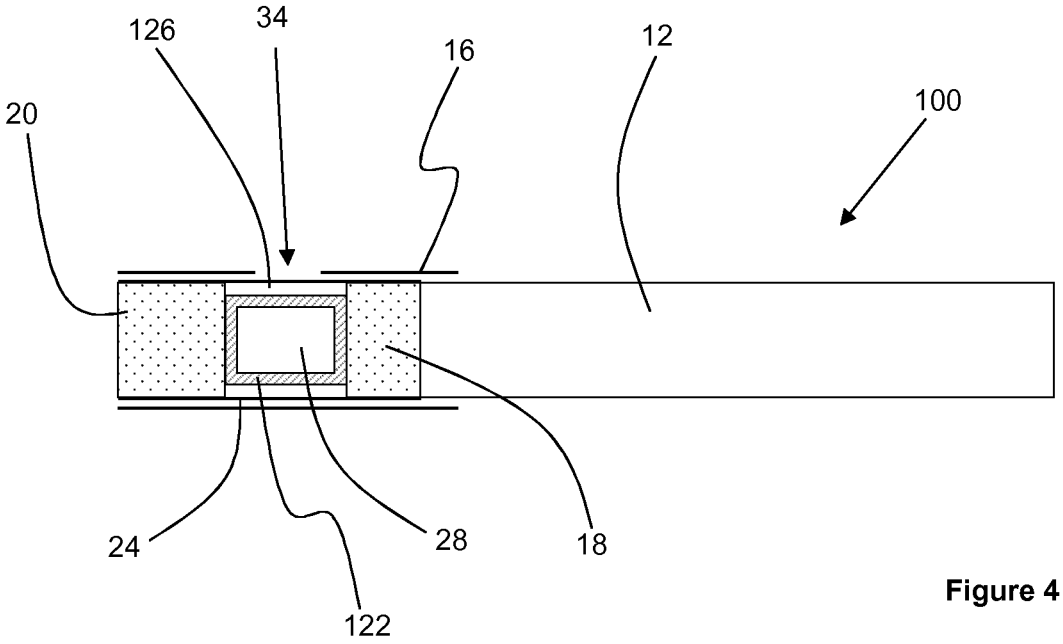
FIG. 4 shows a longitudinal cross-sectional view of the aerosol-generating article of FIG. 1 and comprising a liquid delivery element in accordance with a second embodiment of the present invention.
Figure 5:
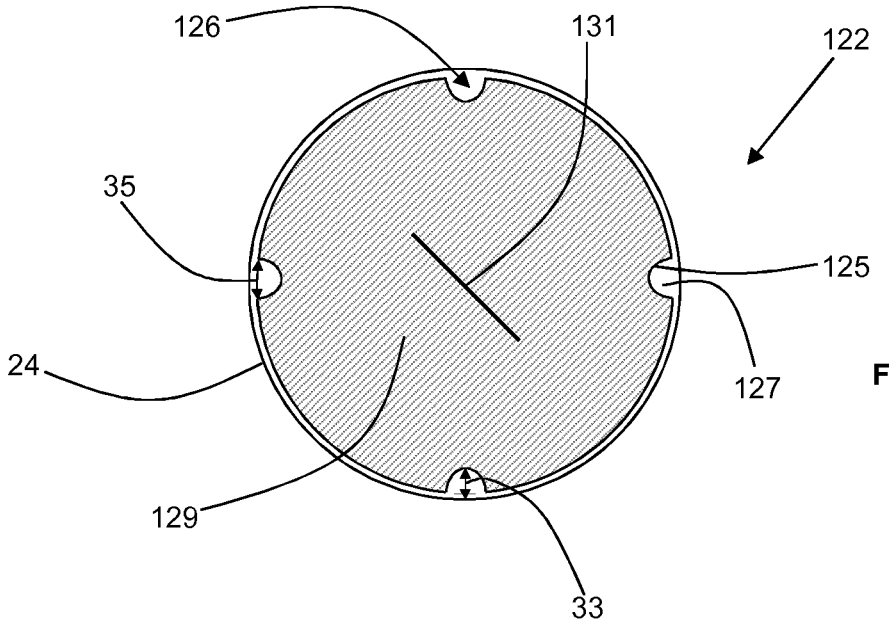
FIG. 5 shows the upstream end of the liquid delivery element of the aerosol-generating article of FIG. 4.

FIGS. 4 and 5 illustrate an aerosol-generating article 100 comprising an alternative liquid delivery element 122. Aside from the liquid delivery element 122, the aerosol-generating article 100 is substantially the same as the aerosol-generating article 10 described with reference to FIGS. 1 to 3, therefore like reference numerals are used to designate like parts.

The liquid delivery element 122 comprises a plurality of channel defining surfaces 125, each surface defining a respective channel 126. Each channel 126 extends between the upstream and downstream ends of the liquid delivery element 122. Each channel 126 is formed by a groove 127 extending along a surface of the liquid delivery element 122 between its upstream and downstream ends, and the combining plug wrap 24 overlying each groove 127. For clarity the plug wrap 24 is spaced apart from the liquid delivery element 122 in FIG. 5, but in practice the plug wrap 24 is glued to the cylindrical surface of the liquid delivery element 122 so that the only space between the plug wrap 24 and the liquid delivery element is in the grooves 127.

The liquid delivery element 122 further comprises an upstream end wall 129 and a slit 131 within the upstream end wall 129. The upstream end wall 129 is deformable when a compressive force is applied to the liquid delivery element 122 so that the upstream end wall 129 forms a deformable portion of the liquid delivery element 122 and the slit 131 forms a valve that is transformable between a closed position and an open position in which the liquid within the cavity 28 can be delivered from the cavity 28 to the upstream filter segment 18.

The embodiments shown in FIGS. 1 to 5 and described above illustrate but do not limit the invention. Other embodiments of the invention may be made without departing from the scope thereof, and it is to be understood that the specific embodiments described herein are not limiting. For example, forming the at least one channel using a groove, as shown in FIGS. 4 and 5, can be combined with a cavity sealed with a frangible portion, as shown in FIGS. 2 and 3. Similarly, forming the liquid delivery element so that the at least one channel extends through the liquid delivery element, as shown in FIGS. 2 and 3, can be combined with a cavity comprising a valve, as shown in FIGS. 4 and 5. Furthermore, it will be appreciated that whilst the specific embodiments described above relate to a conventional smoking article comprising a combustible tobacco rod, similar arrangements could also be used on a distillation-based smoking article or an electrically heated smoking article.

The invention claimed is:

1. An aerosol-generating article having a length extending in a longitudinal direction between upstream and downstream ends of the aerosol-generating article, the aerosol-generating article having a substantially circular cross-sectional shape defining a circumferential direction extending around the longitudinal direction and a radial direction orthogonal to the longitudinal direction and the circumferential direction, the aerosol-generating article comprising an aerosol-generating substrate and a mouthpiece secured to a downstream end of the aerosol-generating substrate, the mouthpiece comprising at least one segment of filter material and a liquid delivery element, the liquid delivery element comprising:

an upstream end and a downstream end;

a wall defining at least a portion of the boundary of a cavity containing a liquid;

said wall comprising a plurality of channel defining surfaces disposed within the wall to define a plurality of channels extending through the wall between the upstream end and the downstream end of the liquid delivery element, wherein each of the plurality of channels has a maximum depth extending in the radial direction and a maximum width extending in the circumferential direction, and wherein the ratio of the maximum depth to the maximum width is between 0.5 to 1 and 2 to 1, and wherein the liquid delivery element further comprises a further wall defining at least a further portion of the boundary of the cavity containing the liquid, said further wall comprising a liquid delivery portion configured to deliver the liquid to the at least one segment of filter material when the liquid delivery element is activated;

wherein the wall comprising the plurality of channel defining surfaces of the liquid delivery element is distinct from the wall comprising the liquid delivery portion of the liquid delivery element.

2. An aerosol-generating article according to claim 1, wherein the liquid delivery portion comprises a valve transformable between a closed position and an open position in which the liquid is delivered to the at least one segment of filter material when the liquid delivery element is activated.

3. An aerosol-generating article according to claim 2, wherein the valve comprises a deformable portion and a slit within the deformable portion, wherein the slit is transformable from the closed position to the open position when a force is applied to the liquid delivery element to deform the deformable portion.

4. An aerosol-generating article according to claim 3, wherein the slit is transformable from the open position to the closed position when the force is removed from the liquid delivery element.

5. An aerosol-generating article according to claim 1, wherein the liquid delivery portion comprises a frangible portion, wherein the frangible portion is configured to release the liquid from the cavity when the frangible portion is broken.

6. An aerosol-generating article according to claim 1, wherein the liquid delivery portion comprises an aperture for providing fluid communication between the cavity and exterior of the liquid delivery element, and a sealing portion covering the aperture.

7. An aerosol-generating article according to claim 1, wherein each of the plurality of channels has a minimum cross-sectional area, and wherein the total of the minimum cross-sectional areas for the total number of channels is between 1 square millimetre and 6 square millimetres.

8. An aerosol-generating article according to claim 1, wherein the aerosol-generating article has a resistance to draw of between 5 millimetres of water gauge and 80 millimetres of water gauge before the liquid is delivered from the liquid delivery element into the at least one segment of filter material.

9. An aerosol-generating article according to claim 1, wherein the aerosol-generating article has a resistance to draw of between 15 millimetres of water gauge and 110 millimetres of water gauge after the liquid is delivered from the liquid delivery element into the at least one segment of filter material.

10. An aerosol-generating article according to claim 1, wherein the liquid delivery element is formed from a substantially transparent material.

11. An aerosol-generating article according to claim 1, wherein the liquid delivery element and the at least one segment of filter material each have a substantially circular cross-sectional shape, and wherein the maximum diameter of the liquid delivery element is substantially the same as the maximum diameter of the at least one segment of filter material.

12. An aerosol-generating article according to claim 1, wherein the at least one segment of filter material comprises a downstream filter segment positioned downstream of the liquid delivery element.

13. An aerosol-generating article according to claim 1, wherein the at least one segment of filter material comprises an upstream filter segment and a downstream filter segment downstream of the upstream filter segment, and wherein the liquid delivery element is positioned between the upstream and downstream filter segments.

* * * * *